US009042797B2

(12) United States Patent
Yamakawa

(10) Patent No.: US 9,042,797 B2
(45) Date of Patent: May 26, 2015

(54) FIXING DEVICE AND IMAGE FORMING APPARATUS

(71) Applicant: KYOCERA Document Solutions Inc., Osaka (JP)

(72) Inventor: Tomohiko Yamakawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/338,651

(22) Filed: Jul. 23, 2014

(65) Prior Publication Data

US 2015/0030358 A1 Jan. 29, 2015

(30) Foreign Application Priority Data

Jul. 29, 2013 (JP) ..... 2013-156246

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
USPC ..... 399/323, 406
See application file for complete search history.

(56) References Cited

U.S. PATENT DOCUMENTS 7,751,768 B2 7/2010 Yamada

FOREIGN PATENT DOCUMENTS

JP 2008-083515 A 4/2008
JP 2012173679 A * 9/2012

* cited by examiner

*Primary Examiner* — Susan Lee
(74) *Attorney, Agent, or Firm* — Studebaker & Brackett PC

(57) ABSTRACT

A fixing device includes a fixing member, a pressing member and a separating member. The fixing member is provided with a sheet passing region through which a recording medium is passed and a non-sheet passing region arranged outside the sheet passing region. The pressing member comes in pressure-contact with the fixing member to form a fixing nip. The separating member is configured to separate the recording medium passed through the fixing nip from the fixing member. The separating member has a separating plate and a restricting piece. The separating plate faces the sheet passing region with an interval. The restricting piece restricts the interval. The restricting piece is provided with a contacting surface which comes in contact with the non-sheet passing region. The contacting surface has a width which becomes wider from an upstream side to a downstream side in the rotation direction of the fixing member.

16 Claims, 9 Drawing Sheets

FIXING DEVICE AND IMAGE FORMING APPARATUS

INCORPORATION BY REFERENCE

This application is based on and claims the benefit of priority from Japanese Patent application No. 2013-156246 filed on Jul. 29, 2013, the entire contents of which are incorporated herein by reference.

BACKGROUND

The present disclosure relates to a fixing device configured to fix a toner image on a recording medium and an image forming apparatus provided with the fixing device.

An electrographic image forming apparatus, such as a copying machine and a printer, is provided with a fixing device configured to fix a toner image on a recording medium such as a sheet . The fixing device includes a fixing member (for example, a fixing roller or a fixing belt) and a pressing member (for example, a pressing roller or a pressing belt) configured to come in pressure-contact with the fixing member. By heating and pressing the recording medium and the toner image at a fixing nip formed between the fixing member and the pressing member, the toner image is fixed on the recording medium.

For example, a fixing deice having the fixing member, the pressing member which comes in pressure-contact with the fixing member to form the fixing nip and a separating member which separates the recording medium passed through the fixing nip from the fixing member is provided. The above separating member has a separating plate which faces a sheet passing region (a region through which the recording medium is passed) of the fixing member with an interval and a restricting piece which comes in contact with a non-sheet passing region (a region outside the sheet passing region).

In the above-mentioned fixing device, when foreign substances (for example, toner, paper powder, shaving chips of a surface coating of the fixing member) are deposited on a space between the non-sheet passing region of the fixing device and the restricting piece of the separating member, the fixing member would be damaged or the foreign substances would adhere on the recording medium to contaminate the recording medium. Alternatively, when the foreign substances are sandwiched between the non-sheet passing region of the fixing member and the restricting piece of the separating member, the interval between the sheet passing region of the fixing member and the separating plate of the separating member would be varied.

SUMMARY

In accordance with an embodiment of the present disclosure, a fixing device includes a fixing member, a pressing member and a separating member. The fixing member is configured to be rotatable. The fixing member is provided with a sheet passing region and a non-sheet passing region. Through the sheet passing region, a recording medium is passed. The non-sheet passing region is arranged outside the sheet passing region. The pressing member is configured to come in pressure-contact with the fixing member to form a fixing nip. The separating member is configured to separate the recording medium passed through the fixing nip from the fixing member. The separating member has a separating plate and a restricting piece. The separating plate faces the sheet passing region with an interval. The restricting piece is configured to restrict the interval between the sheet passing region and the separating plate. The restricting piece is provided with a contacting surface which comes in contact with the non-sheet passing region. The contacting surface has a width which becomes wider from an upstream side to a downstream side in the rotation direction of the fixing member.

In accordance with an embodiment of the present disclosure, an image forming apparatus includes a fixing device. The fixing device has a fixing member, a pressing member and a separating member. The fixing member is configured to be rotatable. The fixing member is provided with a sheet passing region and a non-sheet passing region. Through the sheet passing region, a recording medium is passed. The non-sheet passing region is arranged outside the sheet passing region. The pressing member is configured to come in pressure-contact with the fixing member to form a fixing nip. The separating member is configured to separate the recording medium passed through the fixing nip from the fixing member. The separating member has a separating plate and a restricting piece. The separating plate faces the sheet passing region with an interval. The restricting piece is configured to restrict the interval between the sheet passing region and the separating plate. The restricting piece is provided with a contacting surface which comes in contact with the non-sheet passing region. The contacting surface has a width which becomes wider from an upstream side to a downstream side in the rotation direction of the fixing member.

The above and other objects, features, and advantages of the present disclosure will become more apparent from the following description when taken in conjunction with the accompanying drawings in which a preferred embodiment of the present disclosure is shown by way of illustrative example.

FIG . 5 is a perspective view showing a front end portion and its peripheral portion of the fixing unit, in the fixing device of the color printer according to the embodiment of the present disclosure.

Figure 6:
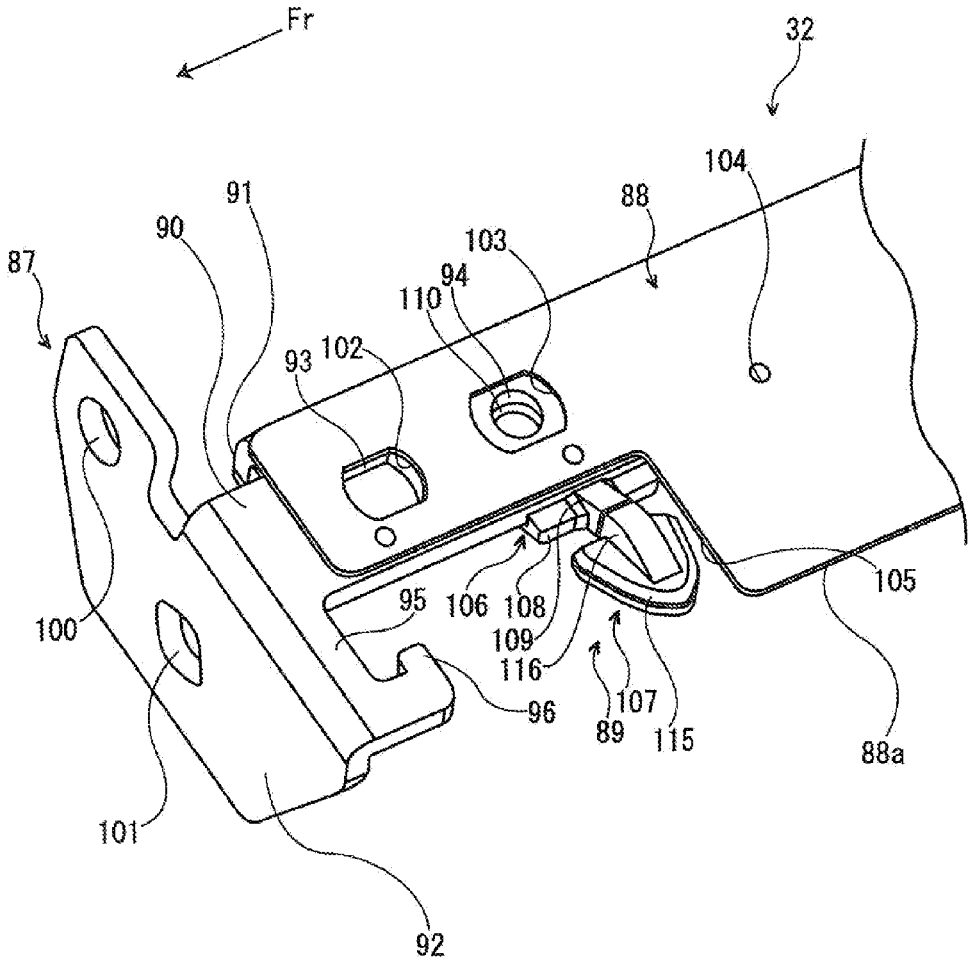

FIG. 6 is a top perspective view showing a separating member, in the fixing device of the color printer according to the embodiment of the present disclosure.

Figure 7:
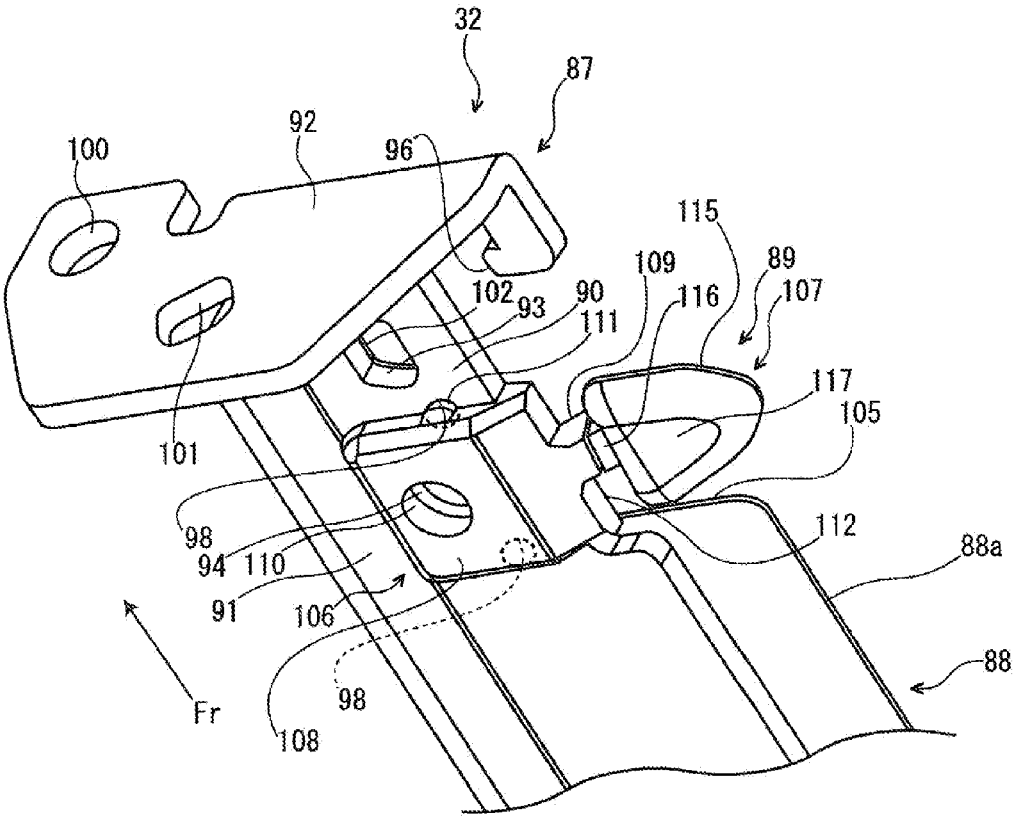

FIG. 7 is a bottom perspective view showing the separating member, in the fixing device of the color printer according to the embodiment of the present disclosure.

Figure 8:
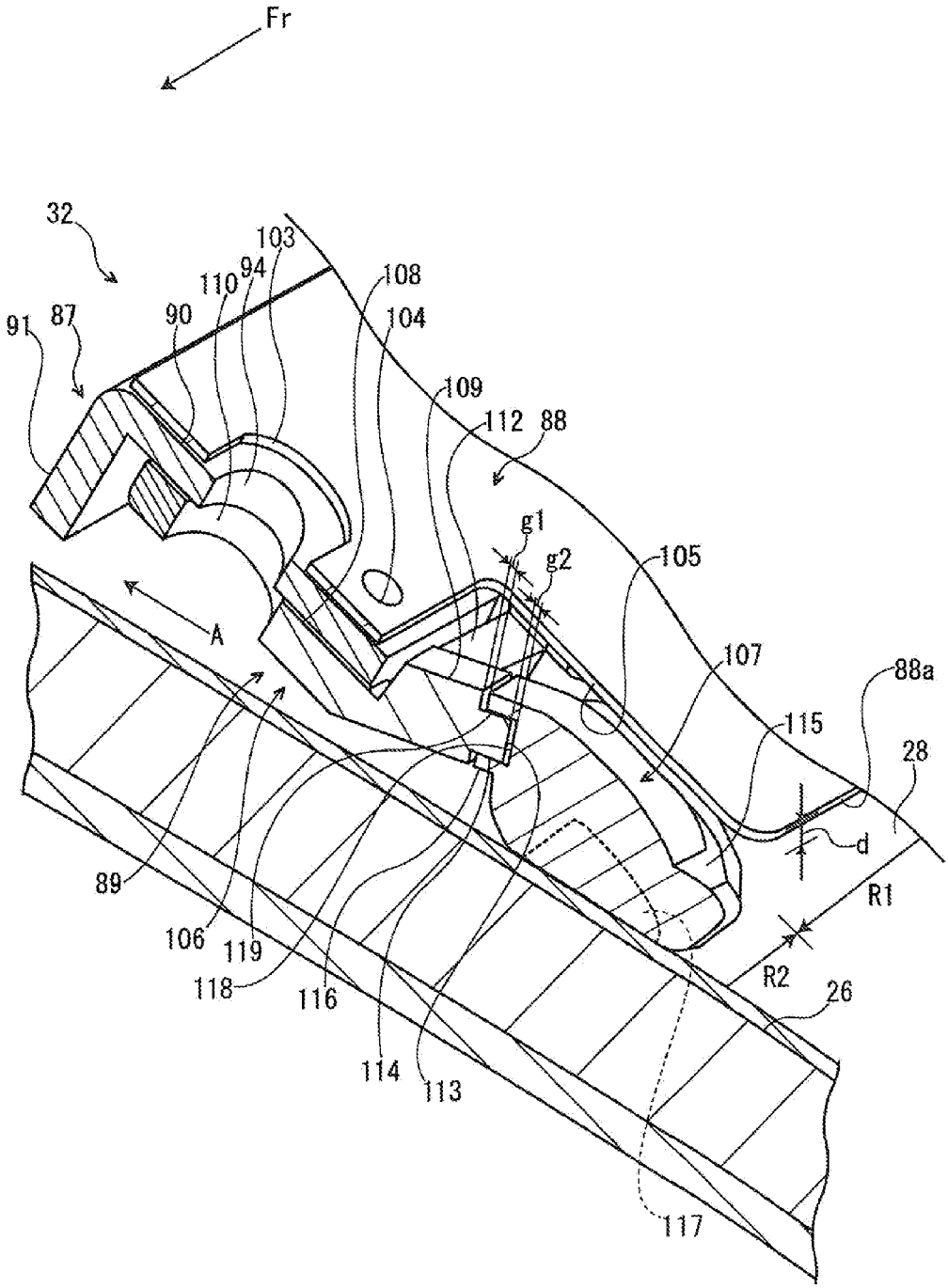

FIG. 8 is a sectional view showing a restricting piece and its peripheral portion, in the fixing device of the color printer according to the embodiment of the present disclosure.

Figure 9:
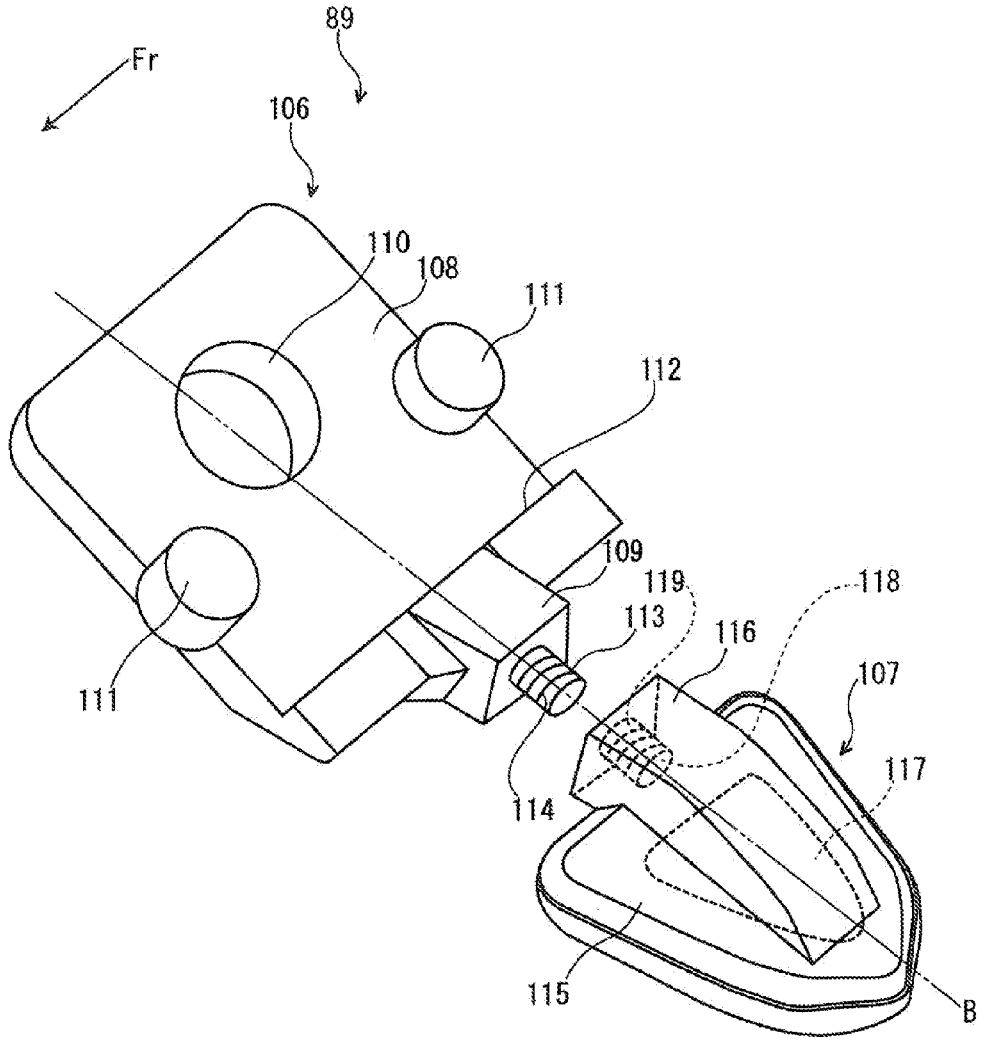

FIG. 9 is an exploded perspective view showing the restricting piece, in the fixing device of the color printer according to the embodiment of the present disclosure.

DETAILED DESCRIPTION

Figure 1:
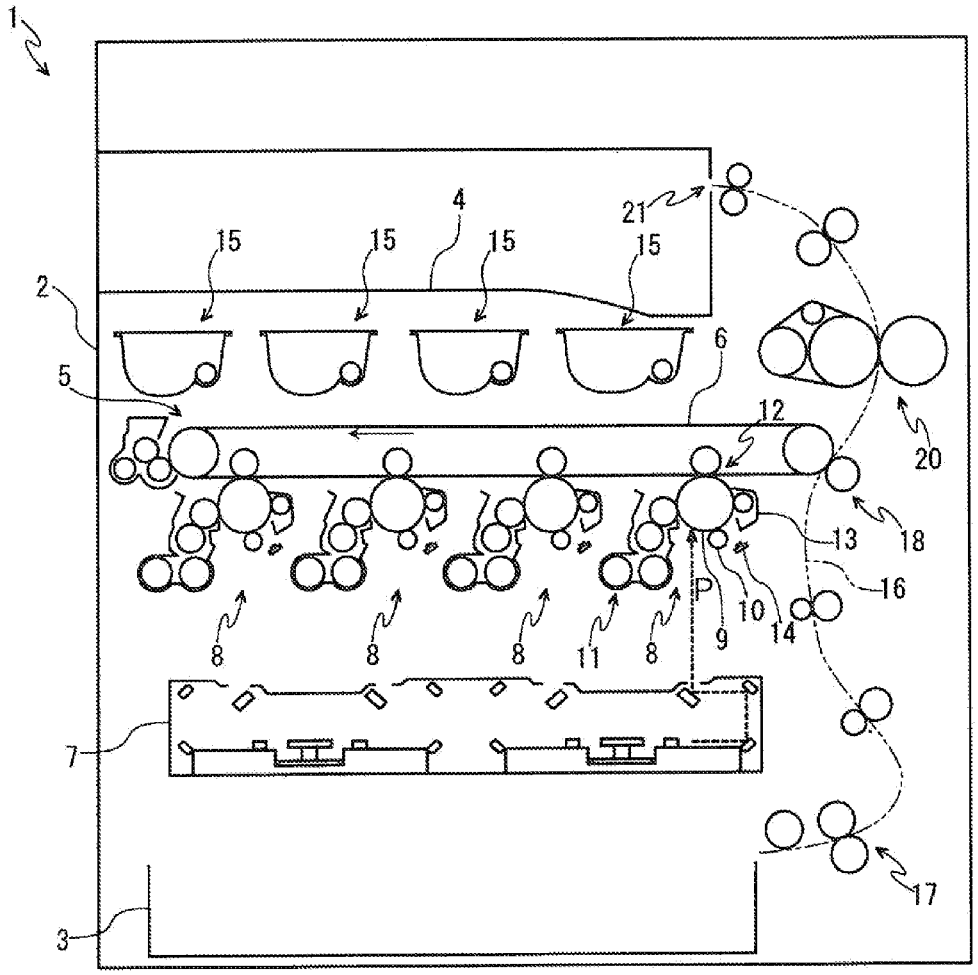
FIG. 1 is a schematic diagram schematically showing a structure of a color printer according to an embodiment of the present disclosure.

First, with reference to FIG. 1, the entire structure of a color printer 1 (an image forming apparatus) will be described.

The color printer 1 includes a box-shaped printer main body 2. In a lower part of the printer main body 2, a sheet feeding cartridge 3 storing sheets (recording mediums) is provided and, on an upper surface of the printer main body 2, a sheet ejecting tray 4 is provided.

In a middle part of the printer main body 2, an intermediate transferring belt 6 is bridged over a plurality of rollers and, below the intermediate transferring belt 6, an exposure device 7 consisting of a laser scanning unit (LSU) is arranged. Under the intermediate transferring belt 6, four image forming units 8 are provided for respective colors (for example, four colors of magenta, cyan, yellow and black) of toners (developers). Hereinafter, one of the four image forming units 8 will be described. In each image forming unit 8, a photosensitive drum 9 is rotatably provided. Around the photosensitive drum 9, a charger 10, a development device 11, a first transferring unit 12, a cleaning device 13 and a static eliminator 14 are arranged in order of a first transferring process. Above the development device 11, four toner containers 15 corresponding to the image forming units 8 are provided for different colors (for example, four colors of magenta, cyan, yellow and black) of toners, respectively.

On one side (the right upper side in the figure) in the printer main body 2, a sheet conveying path 16 extending in the upper and lower directions is provided. At an upper stream end of the conveying path 16, a sheet feeder 17 is provided. At an intermediate stream part of the conveying path 16, a second transferring unit 18 is provided at one end (the right end in the figure) of the intermediate transferring belt 6. At a lower stream part of the conveying path 16, a fixing device 20 is provided. At a lower stream end of the conveying path 16, a sheet ejecting port 21 is provided.

Next, the operation of forming an image by the color printer 1 having such a configuration will be described. When the power is supplied to the color printer 1, various parameters are initialized and initial determination, such as temperature determination of the fixing device 20, is carried out. Subsequently, when image data is inputted and a printing start is directed from a computer or the like connected with the color printer 1, the image forming operation is carried out as follows .

First, the surface of the photosensitive drum 9 is electrically charged by the charger 10. Then, the surface of the photosensitive drum 9 is irradiated with a laser (refer to an arrow P) by the exposure device 7, thereby forming an electrostatic latent image on the surface of the photosensitive drum 9. The electrostatic latent image is then developed to a toner image having a correspondent color by the developing device 11 with a toner supplied from the toner container 15. The toner image is first-transferred onto the surface of the intermediate transferring belt 6 in the first transferring unit 12. The above-mentioned operation is repeated in order by the image forming units 8, thereby forming the toner image having full color on the intermediate transferring belt 6. Toner and electric charge remained on the photosensitive drum 9 are eliminated by the cleaning device 13 and static eliminator 14.

On the other hand, a sheet fed from the sheet feeding cartridge 3 or a manual bypass tray (not shown) by the sheet feeder 17 is conveyed to the second transferring unit 18 in a suitable timing for the above-mentioned image forming operation. Then, in the second transferring unit 18, the toner image having full color on the intermediate transferring belt 6 is second-transferred onto the sheet. The sheet with the second-transferred toner image is conveyed to a lower stream side on the conveying path 16 to enter the fixing device 20, and then, the toner image is fixed on the sheet in the fixing device 20. The sheet with the fixed toner image is ejected from the first sheet ejecting port 21 on the sheet ejecting tray 4.

Figure 2:
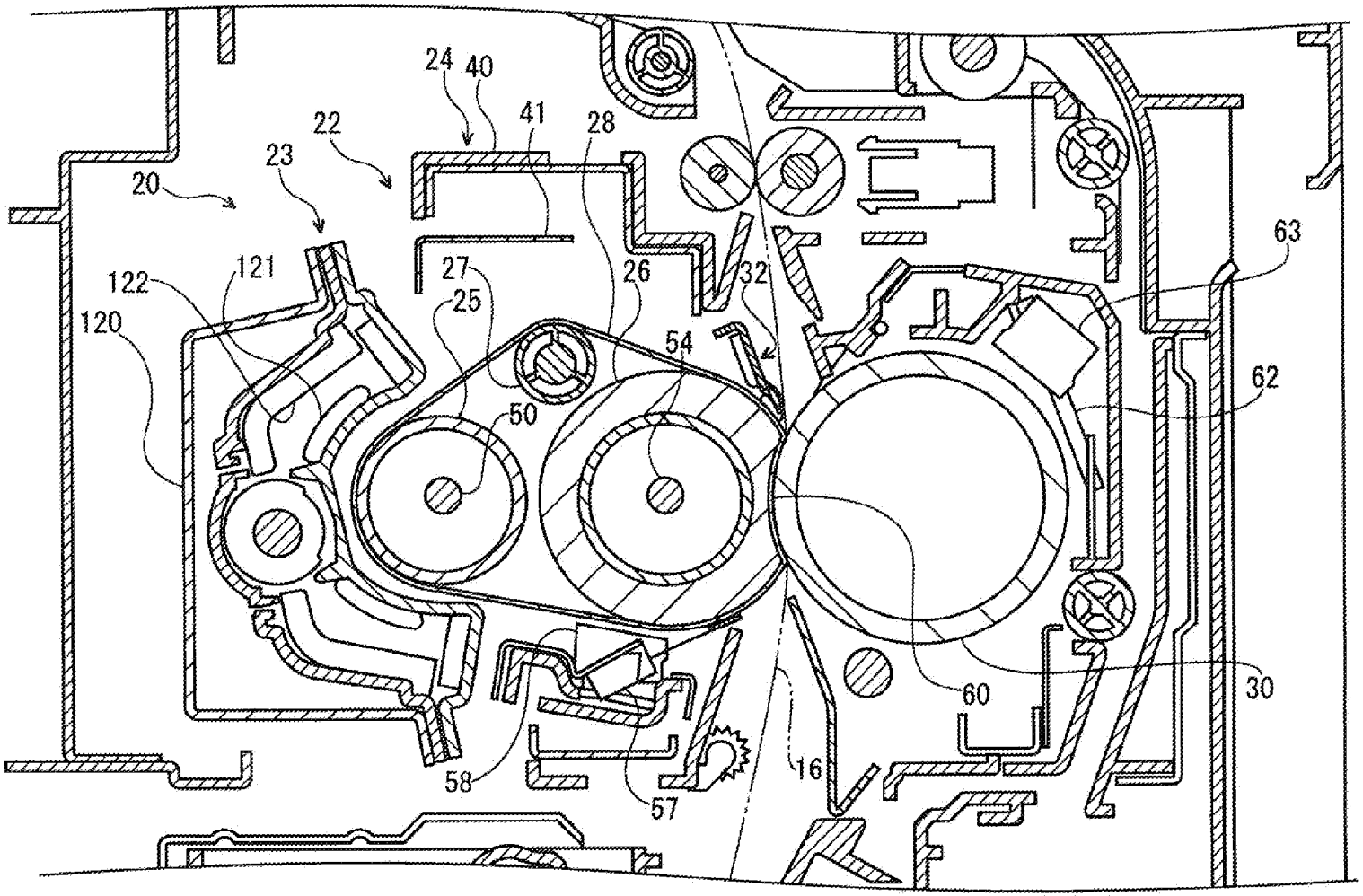
FIG. 2 is a sectional view showing a fixing device of the color printer according to the embodiment of the present disclosure.

Next, the fixing device 20 will be described. Hereinafter, for convenience of explanation, the near side viewed from the paper plane of FIG. 2 is defined as a front side of the fixing device 20. Arrow Fr suitably put on each figure indicates the front side of the fixing device 20.

As shown in FIG. 2, the fixing device 20 is provided with a fixing unit 22 and an IH unit 23 arranged on the left side of the fixing unit 22.

First, the fixing unit 22 will be described. As shown in FIG. 2 and others, the fixing unit 22 includes a box-shaped fixing frame 24, a heating roller 25 arranged in the left side space in the fixing frame 24, a fixing roller 26 arranged on the right side of the heating roller 25, a tension roller 27 arranged on the right upper side of the heating roller 25 and on the left upper side of the fixing roller 26, a fixing belt 28 (a fixing member) wound around the heating roller 25, the fixing roller 26 and the tension roller 27, a pressing roller 30 (a pressing member) arranged on the right side of the fixing belt 28, a nip pressure switching mechanism 31 (refer to FIG. 3 and others) arranged on each of the front and back ends of the fixing frame 24 and a separating member 32 (refer to FIG. 2 and others) arranged on the right upper side of the fixing belt 28.

As shown in FIG. 2, the fixing frame 24 has a fixed frame part 40 and a movable frame part 41 configured to be supported by the fixed frame part 40 in a slidable way in the left and right direction.

Figure 3:
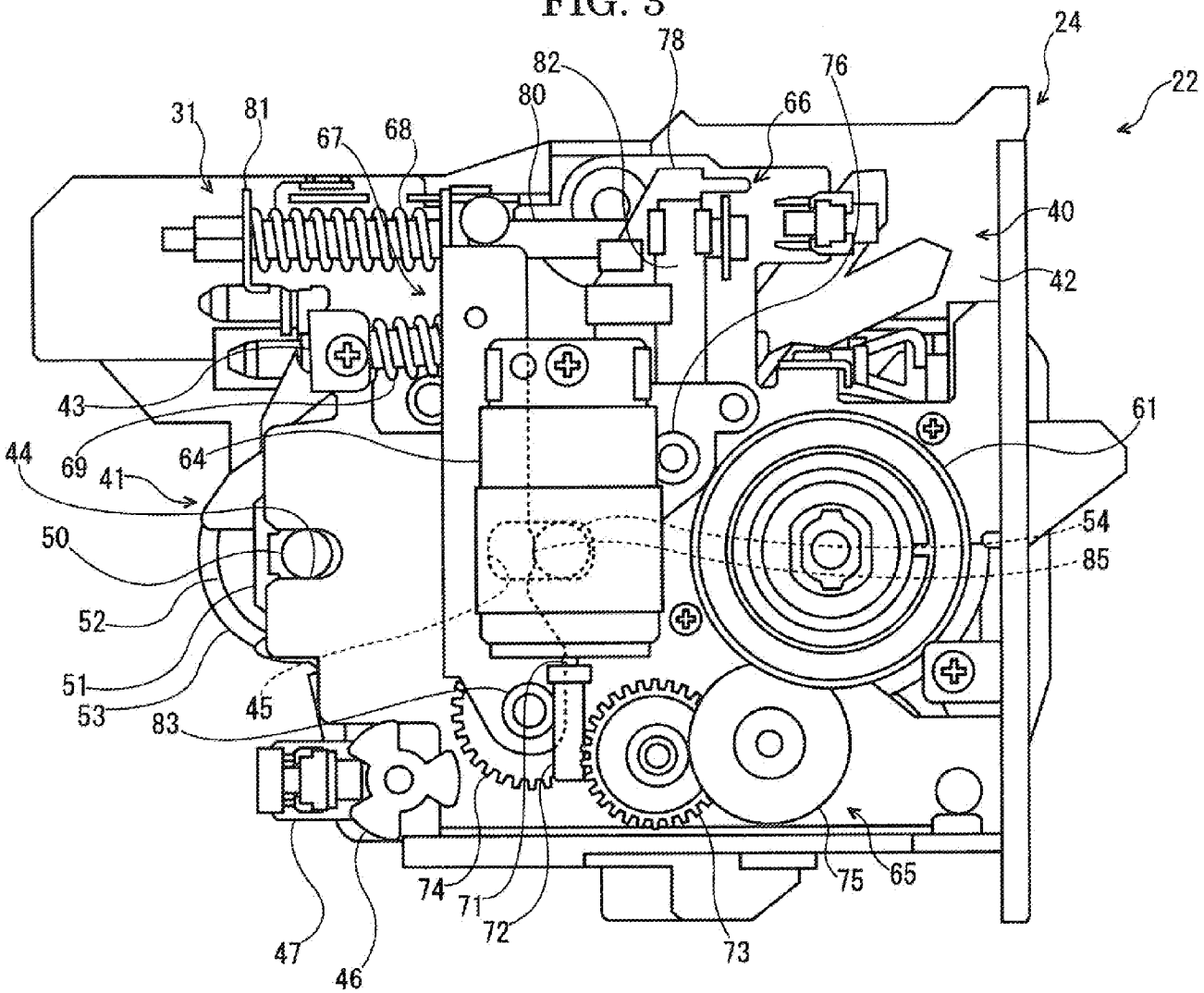
FIG. 3 is a front view showing a fixing unit, in the fixing device of the color printer according to the embodiment of the present disclosure.

As shown in FIG. 3, at the left end of each of the front and back walls 42 (FIG. 2 shows the front wall 42 only) of the fixed frame part 40, a contacting piece 43 is formed. At the left end of each of the front and back walls 42 of the fixed frame part 40, an engaging groove 44 is formed under the contacting piece 43. The engaging groove 44 is formed into a lateral U-shape being long in the left and right directions. At the left side portion of each of the front and back walls 42 of the fixed frame part 40, an engaging hole 45 is formed on the right side of the engaging groove 44. The engaging hole 45 is formed into a long hole extending in the left and right directions.

Figure 4:
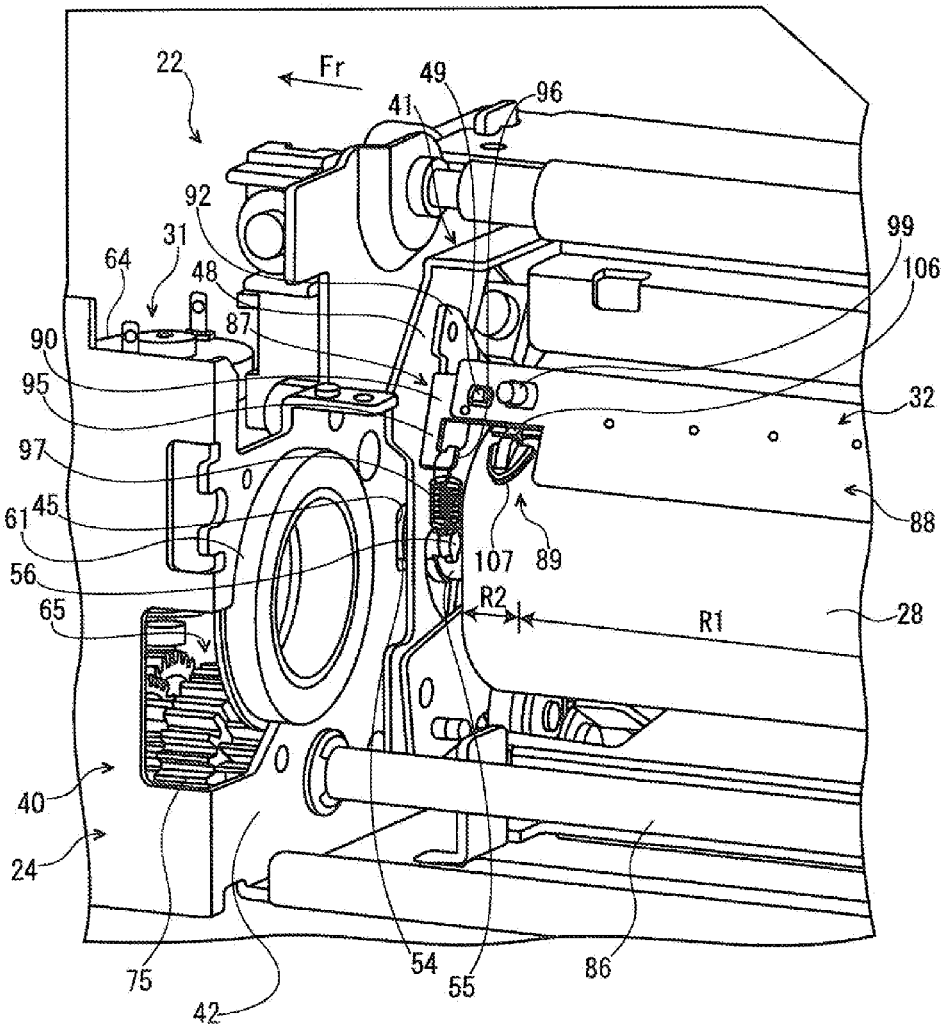
FIG. 4 is a perspective view showing a front end portion and its peripheral portion of a fixing belt, in the fixing device of the color printer according to the embodiment of the present disclosure.

At the left bottom corner of the movable frame part 41, a rotatable detected member 46 is provided. On the left side of the detected member 46, a first sensor 47 is provided. The first sensor 47 is composed of a PI sensor (a Photo Interrupter Sensor). As shown in FIG. 4, on an inner surface of each of front and back plates 48 (FIG. 4 shows the front plate 48 only) of the movable frame part 41, a supporting pivot 49 protruding inwardly is provided.

The heating roller 25 (refer to FIG. 2 and others) is composed of a substrate layer and a release layer formed around the substrate layer, for example. The substrate layer of the heating roller 25 is made from metal such as stainless steel and aluminum, for example. The release layer of the heating roller 25 is made from fluoroethylene resin such as PFA (Perfluoro alkoxy alkane), for example.

The heating roller 25 has a first rotating shaft 50. As shown in FIG. 3 and others, the front and back ends of the first rotating shaft 50 are rotatably supported by the movable frame part 41 via first bearings 51. Thus, the heating roller 25 is rotatably supported by the movable frame part 41. The front and back ends of the first rotating shaft 50 are engaged with the engaging grooves 44 formed at the front and back walls 42 of the fixed frame part 40 in a slidable state in the left and right directions.

To each of the front and back ends of the heating roller 25, a disk-shaped belt flange 52 (refer to FIG. 3 and others) is fixed. On an outer circumference of the belt flange 52 fixed to the front end of the heating roller 25, a rotation detecting gear 53 is formed. The rotation detecting gear 53 is connected to the detected member 46 through a connecting gear (not shown).

The fixing roller 26 (refer to FIG. 2 and others) is composed of a substrate layer and an elastic layer formed around the substrate layer, for example. The substrate layer of the fixing roller 26 is made from metal such as stainless steel or aluminum, for example . The elastic layer of the fixing roller 26 is made from silicon rubber or silicon sponge, for example .

The fixing roller 26 faces the pressing roller 30 via the fixing belt 28. The fixing roller 26 has a second rotating shaft 54. As shown in FIG. 4, the front and back ends of the second rotating shaft 54 are rotatably supported by the front and back plates 48 of the movable frame part 41 with second bearings 55. Thus, the fixing roller 26 is rotatably supported by the movable frame part 41. At the right side portion (the left side portion in FIG. 4) of the outer circumference of the second bearing 55, a column-shaped spring bearing 56 protruding horizontally is provided. As shown in FIG. 3, the front and back ends of the second rotating shaft 54 are engaged with the engaging holes 45 formed at the front and back walls 42 of the fixed frame part 40 in a slidable state in the left and right directions.

The tension roller 27 (refer to FIG. 2 and others) is made from metal such as stainless steel and aluminum, for example. The tension roller 27 is biased by a coil spring (not shown) in a right upper direction to press the fixing belt 28 in a right upper direction. Thus, the tension roller 27 is applied with a constant tension. The tension roller 27 is rotatably supported by the movable frame part 41.

The fixing belt 28 is formed into a flexible endless belt. The fixing belt 28 is composed of a substrate layer, an elastic layer provided around the substrate layer and a release layer coating the elastic layer, for example. The substrate layer of the fixing belt 28 is made from metal such as nickel and stainless steel or resin such as PI (polyimide). The elastic layer of the fixing belt 28 is made from silicon rubber, for example. The release layer of the fixing belt 28 is made from fluoroethylene resin such as PFA (Perfluoro alkoxy alkane), for example. In this embodiment, the front and back directions (the depth direction of the paper plane in FIG. 2) show a width direction of the fixing belt 28.

The fixing belt 28 is rotatably supported by the movable frame part 41 via the heating roller 25, the fixing roller 26 and the tension roller 27. As shown in FIG. 4 and others, the fixing belt 28 has a sheet passing region R1 through which a largest size sheet is passed and a non-sheet passing regions R2 which are arranged outside the sheet passing region R1 and through which the largest size sheet is not passed.

As shown in FIG. 2, under the fixing belt 28, a first thermistor 57 configured to detect a temperature of the fixing belt 28 is arranged. Under the fixing belt 28, a first thermostat 58 configured to prevent excessive temperature rise of the fixing belt 28 is arranged.

The pressing roller 30 is composed of a cylindrical core metal, an elastic layer provided around the core metal and a release layer coating the elastic layer, for example. The core metal of the pressing roller 30 is made from metal such as stainless steel or aluminum, for example. The elastic layer of the pressing roller 30 is made from silicon rubber or silicon sponge, for example. The release layer of the pressing roller 30 is made from fluoroethylene resin such as PFA, for example.

The pressing roller 30 comes in pressure-contact with the fixing belt 28 to form a fixing nip 60 between the fixing belt 28 and the pressing roller 30. The front and back end portions of the pressing roller 30 are rotatably supported by the front and back walls 42 of the fixed frame part 40 via third bearings 61 (refer to FIG. 3 and others). Thus, the pressing roller 30 is rotatably supported by the fixed frame part 40. The pressing roller 30 is connected to a driving part (not shown) consisting of a motor and others so as to be rotated by the driving part.

As shown in FIG. 2, on the right upper side of the pressing roller 30, a second thermistor 62 configured to detect a temperature of the pressing roller 30 is arranged. On the right upper side of the pressing roller 30, a second thermostat 63 configured to prevent excessive temperature rise of the pressing roller 30 is arranged.

As shown in FIG. 3 and others, the nip pressure switching mechanism 31 provided at the front side includes a driving motor 64 (a driving source), a reduction gear mechanism 65 arranged under the driving motor 64 from the right side to the left side, a driving member 66 arranged above the reduction gear mechanism 65, a lever 67 arranged on the left side of the driving member 66, a first coil spring 68 (a first biasing member) and a second coil spring 69 (a second biasing member) arranged on the left side of the lever 67.

Figure 5:
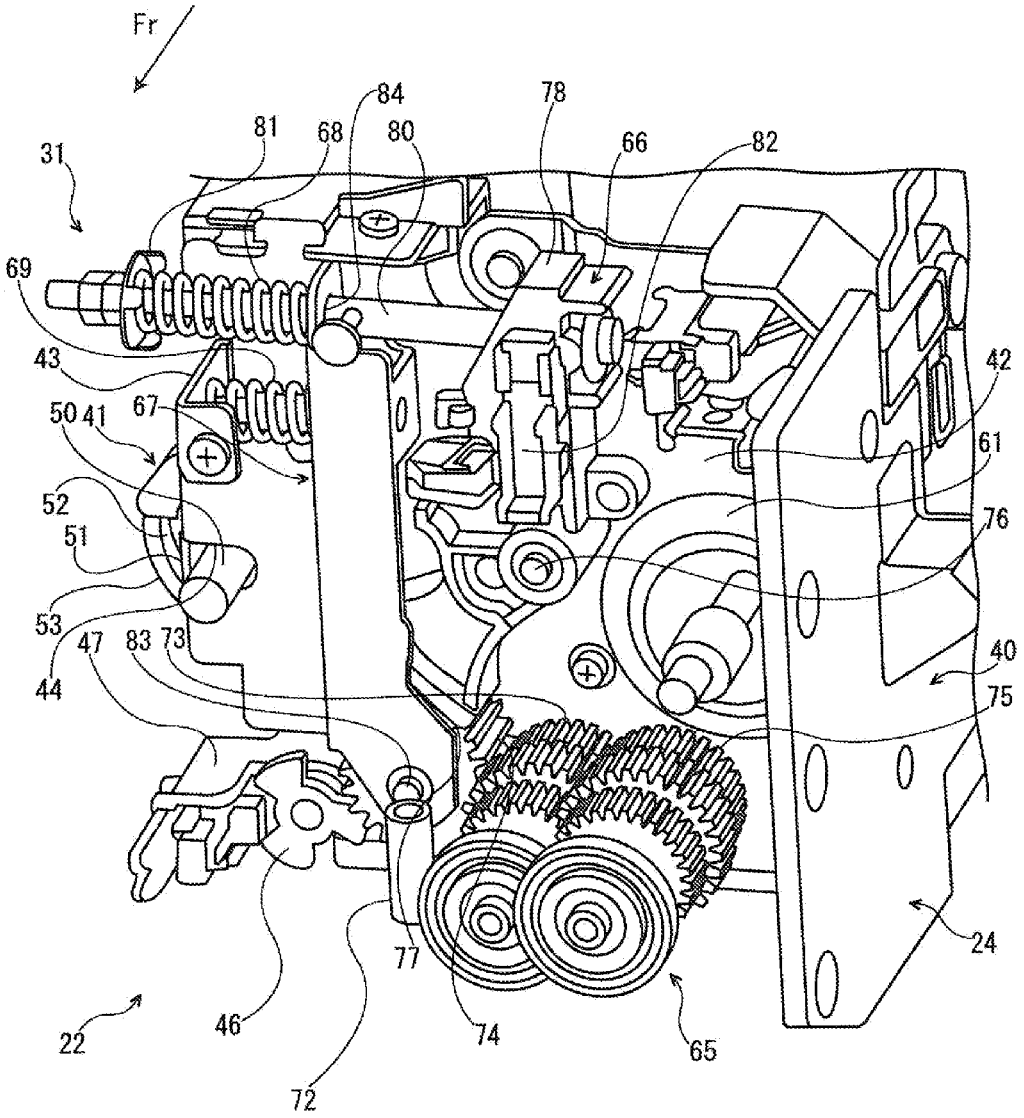

The driving motor 64 is arranged on the front side of the front wall 42 of the fixed frame part 40. The driving motor 64 has a motor shaft 71 extending downward. To the motor shaft 71, a warm gear 72 is fixed concentrically. FIG. 5 shows only the warm gear 72 of the driving motor 64 in order to clearly show the members arranged behind the driving motor 64.

As shown in FIG. 5 and others, the reduction gear mechanism 65 has a first gear 73, a second gear 74 arranged on the left back side of the first gear 73 and a third gear 75 arranged on the right side of the first gear 73. A front stepped part of the first gear 73 is meshed with the warm gear 72 of the driving motor 64. The second gear 74 is meshed with a back stepped part of the first gear 73. The third gear 75 is meshed with the first gear 73.

At an approximate center portion of the driving member 66 in the upper and lower directions, a turning shaft 76 around which the driving member 66 is turnable is formed. At the lower end portion of the driving member 66, a driving gear 77 is formed. The driving gear 77 is meshed with the second gear 74 of the reduction gear mechanism 65. Thus, the driving motor 64 is connected to the driving member 66 via the reduction gear mechanism 65. In other words, the reduction gear mechanism 65 is installed between the driving motor 64 and the driving member 66.

At the upper end portion of the driving member 66, a driving piece 78 is formed. At the upper end portion of the driving member 66, a pressing piece 80 protruding leftward from the driving piece 78 is formed. The pressing piece 80 is formed into a long straight rod shape extending in the left and right directions. At the distal end portion (the left end portion) of the pressing piece 80, a disk-shaped collar part 81 is formed. In front of the driving member 66, a second sensor 82 configured to detect displacement of the driving piece 78 is formed. The second sensor 82 is composed of a PI (Photo Interrupter) sensor, for example.

The lever 67 extends in the upper and lower directions . At the lower end portion of the lever 67, a supporting shaft 83 around which the lever 67 is turnable is formed. At the upper end portion on the lever 67, a through hole 84 through which the pressing piece 80 of the driving member 66 is penetrated is formed. As shown in FIG. 3, at the lower portion of the lever 67, a pressing projection 85 is formed. The pressing projection 85 comes in contact with the second rotating shaft 54 of the fixing roller 26.

As shown in FIG. 5 and others, the first coil spring 68 is coiled around the periphery of the pressing piece 80 of the driving member 66. The left end portion of the first coil spring 68 comes in contact with the collar part 81 of the pressing piece 80 of the driving member 66. The right end portion of the first coil spring 68 comes in contact with the upper end portion of the lever 67. That is, the first coil spring 68 is installed between the pressing piece 80 of the driving member 66 and the lever 67.

The left end portion of the second coil spring 69 comes in contact with the contacting piece 43 formed at each of the front and back walls 42 of the fixed frame part 40. The right end portion of the second coil spring 69 comes in contact with the upper portion of the lever 67. That is, the second coil spring 69 is installed between the fixed frame part 40 and the lever 67.

The nip pressure switching mechanism (not shown) provided on the back side has the same configuration as the above-mentioned nip pressure switching mechanism 31 provided on the front side except that the driving motor 64 is not provided. The nip pressure switching mechanism provided on the backside is coupled to the third gear 75 of the nip pressure switching mechanism 31 provided on the front side through a coupling shaft 86 (refer to FIG. 4).

As shown in FIG. 2 and others, the separating member 32 is arranged on the downstream side of the fixing nip 60 in the sheet conveying direction (a direction from the lower to the upper in this embodiment). As shown in FIG. 6 and others, the separating member 32 has a supporting plate 87, a separating plate 88 supported by the supporting plate 87 and restricting pieces 89 fixed to the front and back ends of the supporting plate 87.

The supporting plate 87 is formed in a long shape extending in the front and back directions. The supporting plate 87 is made from sheet metal, for example. The supporting plate 87 has a flat main body part 90, a bend part 91 bent in the left lower direction from the left upper end of the main body part 90 and attachment parts 92 bent in the left lower direction from the front and back ends of the main body part 90.

At each of the front and back end portions of the main body part 90 of the supporting plate 87, a positioning hole 93 is formed. At each of the front and back end portions of the main body part 90 of the supporting plate 87, a screw hole 94 is formed inside the positioning hole 93 in the front and back directions. At each of the front and back end portions of the main body part 90 of the supporting plate 87, a holding part 95 extending in the right lower direction is formed. At the distal end portion of the holding part 95, an L-shaped hook 96 protruding inwardly in the front and back directions is formed. As shown in FIG. 4, to the hook 96, an upper end portion of a coil spring 97 (a biasing body) is attached. A lower end portion of the coil spring 97 is attached to the spring bearing 56 of the second bearing 55. As shown in FIG. 7, on the bottom surface of the main body part 90 of the supporting plate 87, a pair of positioning grooves 98 are formed.

As shown in FIG. 6 and others, at the left upper portion of each attachment part 92 of the supporting plate 87, a round hole 100 is penetrated. At the center portion of each attachment part 92 of the supporting plate 87, an axial hole 101 is formed. Into the axial hole 101, the supporting pivot 49 (refer to FIG. 4) protruding from the inner surface of each of the front and back plates 48 of the movable frame part 41 is inserted. Thus, the separating member 32 is supported by the movable frame part 41 in a turnable state around the supporting pivot 49.

As shown in FIG. 6 and others, the separating plate 88 is formed into a long flat plate extending in the front and back directions, and joined together with an upper surface of the main body part 90 of the supporting plate 87 . The separating plate 88 is coated with fluoroethylene resin. At each of the front and back end portions of the separating plate 88, a positioning hole 102 is formed so as to correspond to the positioning hole 93 of the main body part 90 of the supporting plate 87. At each of the front and back end portions of the separating plate 88, an insertion hole 103 is formed inside the positioning hole 102 in the front and back directions. At the center portion of the separating plate 88 in the upper and lower directions, welding holes 104 to weld the separating plate 88 to the main body part 90 of the supporting plate 87 are formed in a row at predetermined intervals in the front and back directions.

As shown in FIG. 8, the distal edge 88*a* (the lower edge) of the separating plate 88 faces the sheet passing region R1 of the fixing belt 28 with an interval d. At the front lower corner and the back lower corner of the separating plate 88, approximately rectangle-shaped notch portions 105 are formed.

Each restricting piece 89 is formed as a separated member from the supporting plate 87 and the separating plate 88. As shown in FIG. 7 and others, each restricting piece 89 has a fixed part 106 and a movable part 107 extending in the right lower direction from the fixed part 106.

As shown in FIG. 9, the fixed part 106 of each restricting piece 89 has a flat-plate shaped fixed part main body 108 and a square column-shaped first connecting portion 109 protruding in the right lower direction from the right lower portion of the fixed part main body 108.

At the center portion of the fixed part main body 108 of the fixed part 106, a screw hole 110 is formed. The fixed part main body 108 is formed with positioning bosses 111 at the left and right side of the screw hole 110. While fitting each positioning boss 111 into each of the pair of positioning grooves 98 (refer to FIG. 7) formed on the bottom surface of the main body part 90 of the supporting plate 87, the screw 99 (refer to FIG. 4) is inserted into the screw hole 94 formed in the main body part 90 of the supporting plate 87 and the screw hole 110 so that the fixed part main body 108 of the fixed part 106 is fixed to the supporting plate 87. As shown in FIG. 9, at the right lower portion of the fixed part main body 108, a protruded edge portion 112 is formed.

On the distal end surface (a surface on the side of the movable part 107) of the first connecting portion 109 of the fixed part 106, an engaging protrusion 113 is formed. The engaging protrusion 113 is formed into a column shape coaxially with a rotation axis B. On the outer circumference of the engaging protrusion 113, a protrusion side thread 114 is formed.

The movable part 107 of each restricting piece 89 has an approximately fan-shaped movable part main body 115 and a square column-shaped second connecting portion 116 protruding in the left upper direction from the left upper portion of the movable part main body 115.

As shown in FIG. 8 and others, on the bottom surface of the movable part main body 115 of the movable part 107, a contacting surface 117 is formed. The contacting surface 117 comes in contact with the non-sheet passing region R2 of the fixing belt 28. Thus, the interval d between the sheet passing region R1 of the fixing belt 28 and the distal edge 88*a* of the separating plate 88 is restricted to a predetermined value. The contacting surface 117 is formed into an approximately triangular sail shape having a width which becomes wider from the upstream side (the right lower side in FIG. 8) to the downstream side (the left upper side in FIG. 8) in the rotation direction A of the fixing belt 28.

As shown in FIG. 9, on the distal surface (a surface on the side of the fixed part 106) of the second connecting portion 116 of the movable part 107, an engaging depression 118 is formed. The engaging depression 118 is formed into a column shaped space coaxially with the rotation axis B. The engaging depression 118 is engaged with the engaging protrusion 113. On the inner circumference of the engaging depression 118, a depression side thread 119 is formed. The depression side thread 119 is meshed with the protrusion side thread 114 of the engaging protrusion 113. By the above configuration, the movable part 107 is supported by the fixed part 106 in a turnable state around the rotation axis B.

As shown in FIG. 8, between the distal end surface of the first connecting portion 109 of the fixed part 106 and the distal end surface of the second connecting portion 116 of the movable part 107, a gap g1 is formed. Between the distal end portion of the engaging protrusion 113 and the bottom portion of the engaging depression 118, a gap g2 is formed. This allows the movable part 107 to be rotated in a normal direction and a reverse direction.

Next, the IH unit 23 will be described. As shown in FIG. 2, the IH unit 23 includes a case member 120, an IH coil 121 (a heating source) stored in the case member 120 and formed in an arc shape around the periphery of the fixing belt 28 and an arcuate core 122 stored in the case member 120 and formed around the periphery of the IH coil 121.

In the fixing device 18 having the above-mentioned configuration, when the toner image is fixed to the sheet, the driving part (not shown) is driven to rotate the pressing roller 30. When the pressing roller 30 is rotated, the fixing belt 28 which comes in contact with the pressing roller 30 is rotated in the direction reverse to the pressing roller 30. Furthermore, when the toner image is fixed on the sheet, the IH coil 121 is applied with a high frequency current. Thus, the IH coil 121 generates a magnetic field which produces an eddy current in the fixing belt 28 to heat the fixing belt 28. Under this state, when the sheet is passed through the fixing nip 60, the sheet and the toner image are heated and pressed to fix the toner image on the sheet. The sheet passed through the fixing nip 60 is separated from the fixing belt 28 by the separating plate 88 of the separating member 32.

When such the fixing operation is repeated, foreign substances (for example, toner, paper powder and shading chips of the surface coating layer of the fixing belt 28) may be deposited or sandwiched between the non-sheet passing region R2 of the fixing belt 28 and the restricting piece 89 of the separating member 32.

However, in the present embodiment, since the contacting surface 117 of the restricting piece 89 has the width which becomes wider from the upstream side to the downstream side in the rotation direction A of the fixing belt 28, the foreign substances are hardly deposited between the non-sheet passing region R2 of the fixing belt 28 and the restricting piece 89 of the separating member 32. Therefore, the fixing belt 28 is hardly damaged so as to prolong the lifetime of the fixing belt 28. Furthermore, since the foreign substances are hardly attached on the sheet, the sheet can be prevented from being contaminated.

Furthermore, by applying the above-mentioned configuration, the foreign substances are hardly sandwiched between the non-sheet passing region R2 of the fixing belt 28 and the restricting piece 89 of the separating member 32. Therefore, since the interval d between the sheet passing region R1 of the fixing belt 28 and the distal edge 88*a* of the separating plate 88 is prevented from being varied, a separating performance (a performance to separate the sheet from the fixing belt 28) of the separating member 32 can be stabilized.

The restricting piece 89 has the fixed part 106 configured to be fixed to the supporting plate 87 and the movable part 107 supported by the fixed part 106 in a turnable state around the rotation axis B and having the contacting surface 117. By applying such a configuration, when the fixing belt 28 is inclined relative to the separating member 32, for example, when the fixing belt 28 is undulated, since the movable part 107 of the restricting piece 89 is turned relative to the fixed part 106, it becomes possible to contact the contacting surface 117 of the restricting piece 89 to the non-sheet passing region R2 of the fixing belt 28 uniformly. Therefore, a sudden rise in the surface pressure of the fixing belt 28 caused by contacting the edge of the contacting surface 117 of the restricting piece 89 to the non-sheet passing region R2 of the fixing belt 28 can be prevented. Accordingly, the fixing belt 28 is more hardly damaged and therefore it becomes possible to more prolong the lifetime of the fixing belt 28.

The fixed part 106 of the restricting piece 89 is formed with the column-shaped engaging protrusion 113 coaxially with the rotation axis B, and the movable part 107 of the restricting piece 89 is formed with the engaging depression 118 formed into a column-shaped space coaxially with the rotation axis B and engageable with the engaging protrusion 113. By applying such a configuration, the movable part 107 can be rotatable relative to the fixed part 106 by using a simple structure.

On the outer circumference of the engaging protrusion 113, the protrusion side thread 114 is formed, and on the inner circumference of the engaging depression 118, a depression side thread 119 capable of screwing with the protrusion side thread 114 is formed. By applying such a configuration, the movable part 107 can be prevented from being fallen from the fixed part 106 by using a simple structure.

Since the fixing belt 28 formed into the flexible endless belt is used as the fixing member, it becomes possible to decrease a heat capacity of the fixing member compared with a case in which the fixing member is formed into a roller. Accordingly, it becomes possible to decrease a warming-up time and save energy.

The present embodiment shows a case in which the fixed part 106 of the restricting piece 89 is formed with the engaging protrusion 113 and the movable part 107 of the restricting piece 89 is formed with the engaging depression 118. On the other hand, in another embodiments, the fixed part 106 of the restricting piece 89 may be formed with the engaging depression and the movable part 107 of the restricting piece 89 may be formed with the engaging protrusion.

The present embodiment shows a case in which the configuration of the present disclosure is applied to the fixing device 20 configured such that the fixing belt 28 is wound around a plurality of rollers (the heating roller 25, the fixing roller 26 and the tension roller 27) installed inside the fixing belt 28. On the other hand, in another embodiments, the configuration of the present disclosure may be applied to a fixing device configured such that the fixing belt 28 is wound around one roller installed inside the fixing belt 28 and another fixing device configured such that the fixing belt 28 is slide relative to a pressing member installed inside the fixing belt 28.

In the present embodiment, a case in which the fixing member is formed into the fixing belt 28 is described. In another embodiments, the fixing member may be formed into a fixing roller.

In the present embodiment, a case in which the IH coil 121 is used as the heating source is described. In another embodiments, a heater such as a halogen heater and a ceramic heater may be used as the heating source.

In the embodiment, while the configuration of the disclosure is applied to the color printer 1, in another embodiment, the configuration of the disclosure may be applied to a monochrome printer, a copying machine, a facsimile, a multifunction peripheral or the like.

While the present disclosure has been described with reference to the particular illustrative embodiments, it is not to be restricted by the embodiments . It is to be appreciated that those skilled in the art can change or modify the embodiments without departing from the scope and spirit of the present disclosure.

What is claimed is:

1. A fixing device comprising:

a fixing member configured to be rotatable and provided with a sheet passing region through which a recording medium is passed and a non-sheet passing region arranged outside the sheet passing region;

a pressing member configured to come in pressure-contact with the fixing member to form a fixing nip; and a separating member configured to separate the recording medium passed through the fixing nip from the fixing member, the separating member including a separating plate facing the sheet passing region with an interval and a restricting piece configured to restrict the interval between the sheet passing region and the separating plate and provided with a contacting surface which comes in contact with the non-sheet passing region and has a width which becomes wider from an upstream side to a downstream side in the rotation direction of the fixing member.

2. The fixing device according to claim 1, wherein the separating member further includes a supporting plate configured to support the separating plate, and the restricting piece has a fixed part fixed to the supporting plate and a movable part supported by the fixed part in a rotatable state around a rotation axis and provided with the contacting surface.

3. The fixing device according to claim 2, wherein one of the fixed part and the movable part is provided with an engaging protrusion formed into a column shape coaxially with the rotation axis, and the other of the fixed part and the movable part is provided with an engaging depression formed into a column shape coaxially with the rotation axis and engageable with the engaging protrusion.

4. The fixing device according to claim 3, wherein an outer circumference of the engaging protrusion is formed with a protrusion side thread, and an inner circumference of the engaging depression is formed with a depression side thread capable of screwing with the protrusion side thread.

5. The fixing device according to claim 3, wherein the fixed part has a fixed part main body fixed to the supporting plate and a first connecting portion protruding from the fixed part main body, the engaging protrusion or the engaging depression is formed on a distal end surface of the first connecting portion.

6. The fixing device according to claim 3, wherein the movable part has a movable part main body having the contacting surface and a second connecting portion protruding from the movable part main body, the engaging protrusion or the engaging depression is formed on a distal end surface of the second connecting portion.

7. The fixing device according to claim 2, wherein the movable part is rotatable in a normal direction and a reverse direction.

8. The fixing device according to claim 1, wherein the fixing member is a fixing belt.

9. An image forming apparatus comprising a fixing device, wherein the fixing device includes:

a fixing member configured to be rotatable and provided with a sheet passing region through which a recording medium is passed and a non-sheet passing region arranged outside the sheet passing region;

a pressing member configured to come in pressure-contact with the fixing member to form a fixing nip; and a separating member configured to separate the recording medium passed through the fixing nip from the fixing member, the separating member including a separating plate facing the sheet passing region with an interval and a restricting piece configured to restrict the interval between the sheet passing region and the separating plate and provided with a contacting surface which comes in contact with the non-sheet passing region and has a width which becomes wider from an upstream side to a downstream side in the rotation direction of the fixing member.

10. The image forming apparatus according to claim 9, wherein the separating member further includes a supporting plate configured to support the separating plate, and the restricting piece has a fixed part fixed to the supporting plate and a movable part supported by the fixed part in a rotatable state around a rotation axis and provided with the contacting surface .

11. The image forming apparatus according to claim 10, wherein one of the fixed part and the movable part is provided with an engaging protrusion formed into a column shape coaxially with the rotation axis, and the other of the fixed part and the movable part is provided with an engaging depression formed into a column shape coaxially with the rotation axis and engageable with the engaging protrusion.

12. The image forming apparatus according to claim 11, wherein an outer circumference of the engaging protrusion is formed with a protrusion side thread, and an inner circumference of the engaging depression is formed with a depression side thread capable of screwing with the protrusion side thread.

13. The image forming apparatus according to claim 11, wherein the fixed part has a fixed part main body fixed to the supporting plate and a first connecting portion protruding from the fixed part main body, the engaging protrusion or the engaging depression is formed on a distal end surface of the first connecting portion.

14. The image forming apparatus according to claim 11, wherein the movable part has a movable part main body having the contacting surface and a second connecting portion protruding from the movable part main body, the engaging protrusion or the engaging depression is formed on a distal end surface of the second connecting portion.

15. The image forming apparatus according to claim 10, wherein the movable part is rotatable in a normal direction and a reverse direction.

16. The image forming apparatus according to claim 9, wherein the fixing member is a fixing belt.

* * * * *